US008556454B2

(12) United States Patent
Pei et al.

(10) Patent No.: US 8,556,454 B2
(45) Date of Patent: Oct. 15, 2013

(54) LIGHT TUBE

(75) Inventors: Chien-Chang Pei, Taipei (TW); Yi-Hung Chen, Taipei (TW)

(73) Assignee: Everlight Electronics Co., Ltd., New Taipei (TW)

( * ) Notice: Subject to any disclaimer, the term of this patent is extended or adjusted under 35 U.S.C. 154(b) by 815 days.

(21) Appl. No.: 12/611,934

(22) Filed: Nov. 4, 2009

(65) Prior Publication Data

US 2010/0110685 A1 May 6, 2010

(30) Foreign Application Priority Data

Nov. 4, 2008 (TW) ..... 97142572 A
Feb. 27, 2009 (TW) ..... 98106471 A

(51) Int. Cl.
*F21S 6/00* (2006.01)

(52) U.S. Cl.
USPC ..... 362/221; 362/217.01; 362/217.1; 362/218; 362/219; 362/249.01; 362/249.2; 362/294; 439/619

(58) Field of Classification Search
USPC ..... 362/249.01, 249.02, 555, 235, 217.01, 362/217.05, 217.1, 218, 219, 221, 294; 439/619, 699.1; 313/39, 42, 360.1, 313/494, 498, 594
See application file for complete search history.

(56) References Cited

U.S. PATENT DOCUMENTS 4,631,377 A 12/1986 Imazeki et al.
5,709,554 A 1/1998 Savage, Jr.
6,409,530 B1 6/2002 Zhao et al.
7,070,418 B1 7/2006 Wang
7,101,230 B2 9/2006 Ma
7,322,828 B1 1/2008 Chiang
D584,429 S 1/2009 Pei et al.
7,527,525 B2 5/2009 Long et al.
7,527,531 B2 5/2009 Lin (Continued)

FOREIGN PATENT DOCUMENTS

CN 101140848 3/2008
CN 201078687 6/2008

(Continued)

OTHER PUBLICATIONS

"Notice of Allowance of counterpart U.S. Appl. No. 12/368,974", issued on Jul. 14, 2009, p. 1-p. 7.

(Continued)

*Primary Examiner* — Mary McManmon
(74) *Attorney, Agent, or Firm* — Jianq Chyun IP Office

(57) ABSTRACT

A light tube including a heat sink, a light transmissive cover disposed on the heat sink, and at least one light source module is provided. A containing space is formed between the heat sink and the light transmissive cover. The light source module includes a carrier, a plurality of first light-emitting devices, a plurality of second light-emitting devices, and a plurality of non-light-emitting passive devices. The carrier is disposed on the heat sink. The first light-emitting devices are arranged on the carrier along a first straight reference line to form a first line of light-emitting devices. The second emitting devices are arranged on the carrier along a second straight reference line to form a second line of light-emitting devices. The non-light-emitting passive devices are disposed on the carrier and between the first and second lines of light-emitting devices and electrically connected to the first and the second light-emitting devices.

22 Claims, 14 Drawing Sheets

(56) References Cited

U.S. PATENT DOCUMENTS

| | | | | |
|---|---|---|---|---|
| 7,611,260 | B1 * | 11/2009 | Lin et al. | 362/224 |
| 7,621,782 | B1 * | 11/2009 | Chen et al. | 439/619 |
| 7,833,060 | B2 | 11/2010 | Tsai | |
| 7,896,701 | B2 * | 3/2011 | Pei et al. | 439/619 |
| 7,988,492 | B2 * | 8/2011 | Pei et al. | 439/619 |
| 2002/0114155 | A1 * | 8/2002 | Katogi et al. | 362/219 |
| 2005/0185396 | A1 * | 8/2005 | Kutler | 362/218 |
| 2005/0265019 | A1 * | 12/2005 | Sommers et al. | 362/217 |
| 2005/0276052 | A1 | 12/2005 | Shimada et al. | |
| 2006/0166562 | A1 | 7/2006 | Ma | |
| 2007/0070631 | A1 | 3/2007 | Huang et al. | |
| 2007/0183156 | A1 * | 8/2007 | Shan | 362/277 |
| 2008/0247191 | A1 * | 10/2008 | Hsu | 362/612 |
| 2008/0298058 | A1 * | 12/2008 | Kan et al. | 362/240 |
| 2009/0147504 | A1 * | 6/2009 | Teeters | 362/153 |
| 2010/0019689 | A1 * | 1/2010 | Shan | 315/294 |

FOREIGN PATENT DOCUMENTS

| | | |
|---|---|---|
| CN | 101349403 | 1/2009 |
| CN | 201177246 | 1/2009 |
| CN | 101740984 | 8/2011 |
| JP | 2002093204 | 3/2002 |
| TW | 200710502 | 3/2007 |
| TW | M315415 | 7/2007 |
| TW | M330662 | 4/2008 |
| TW | M337036 | 7/2008 |
| TW | M347522 | 12/2008 |

OTHER PUBLICATIONS

"The extended European search report of European counterpart application", issued on Apr. 3, 2010, p. 1-p. 6.

"Notice of Allowance of counterpart U.S. Appl. No. 12/578,596", issued on Nov. 16, 2010, p. 1-p. 7.

"Office Action of counterpart U.S. Appl. No. 12/948,819", issued on Mar. 9, 2011, p. 1-p. 10.

"First Office Action of China Counterpart Application", issued on Mar. 23, 2011, p. 1-p. 7, in which the listed references were cited.

* cited by examiner

LIGHT TUBE

CROSS-REFERENCE TO RELATED APPLICATION

This application claims the priority benefits of Taiwan application serial No. 97142572, filed on Nov. 4, 2008 and Taiwan application serial No. 98106471, filed on Feb. 27, 2009. The entirety of each of the above-mentioned patent applications is hereby incorporated by reference herein and made a part of this specification.

BACKGROUND OF THE INVENTION

1. Field of the Invention

The present invention generally relates to a light source, and more particularly, to a light tube.

2. Description of Related Art

The power and light intensity of light-emitting diode (LED) have been increased along with the development of semiconductor technology. Moreover, LED has been broadly applied to different products (for example, illumination devices, traffic lights, displays, and optical mice, etc) and is about to replace the conventional fluorescent light tube due to its many advantages, such as low power consumption, long lifespan, environment friendliness, quick launch, and small volume.

Conventionally, a LED light tube is fastened to the base of a conventional fluorescent light tube by using a fastener. However, the fastener used for fastening the LED light tube is not conductive. Accordingly, an additional conductive wire has to be disposed for electrically connecting the circuit board in the LED light tube and the base. The conductive wire has to be manually welded to the circuit board in the LED light tube and the base in order to electrically connect the two. As a result, the assembly and disassembly of the LED light tube are very inconvenient and it is very difficult and time-consuming to replace the LED light tube.

In order to resolve foregoing problem, two electrode poles of a conventional fluorescent light tube which are suitable for being inserted into the socket on the base can be directly welded to the circuit board. However, through such a method, the problem of insufficient structure strength may be produced, and the parallelism between the two electrode poles may be adversely affected. To be specific, if the electrode poles of a LED light tube are inserted into the socket on a base and the LED light tube is turned to a fastened position through the method for assembling a conventional fluorescent light tube, the force for turning the LED light tube may break the welding points between the electrode poles and the circuit board so that the electrode poles may fall off from the circuit board. Besides, when the electrode poles are welded onto the circuit board, it is very difficult to maintain the parallelism between the two electrode poles. Thereby, such a design may reduce the production yield.

Additionally, in a conventional LED light tube, the LED is disposed in the center of the circuit board. As a result, the LED is centralized within a specific area on the circuit board. Since LED is highly directional, the light emitted by a LED light tube may be too concentrated and accordingly the LED light tube may not be suitable for illumination of general purpose if the disposition of the LED is highly centralized. Besides, if the disposition of LED is too centralized, the heat produced by the LED cannot be dissipated efficiently. As a result, the heat dissipation efficiency of the LED light tube is reduced, and accordingly the light emitting efficiency and lifespan of the LED light tube are reduced.

SUMMARY OF THE INVENTION

Accordingly, the present invention is directed to a light tube which emits a uniform light and offers an excellent heat dissipation capability.

An embodiment of the present invention provides a light tube including a heat sink, a light transmissive cover, and at least one light source module. The heat sink has a carrying surface. The light transmissive cover is disposed on the heat sink, wherein a containing space is formed between the heat sink and the light transmissive cover, and the carrying surface faces the containing space. The light source module includes a carrier, a plurality of first light-emitting devices, a plurality of second light-emitting devices, and a plurality of non-light-emitting passive devices. The carrier is disposed on the carrying surface and located within the containing space. The first light-emitting devices are arranged on the carrier along a first straight reference line, so as to form a first line of light-emitting devices. The second light-emitting devices are arranged on the carrier along a second straight reference line, so as to form a second line of light-emitting devices. A separation space is kept between the first line of light-emitting devices and the second line of light-emitting devices. The non-light-emitting passive devices are disposed on the carrier and located within the separation space, wherein the non-light-emitting passive devices are electrically connected to the first light-emitting devices and the second light-emitting devices.

According to an embodiment of the present invention, the first light-emitting devices and the second light-emitting devices are all light-emitting diodes (LEDs).

According to an embodiment of the present invention, the non-light-emitting passive devices include at least one of resistors, fuses, and Schottky diodes.

According to an embodiment of the present invention, the carrier has a plurality of first through holes which are extended from the separation space to the carrying surface and run through the carrier. The light tube further includes a plurality of first locking elements which respectively run through the first through holes to lock the carrier onto the heat sink.

According to an embodiment of the present invention, the width of the separation space in the direction perpendicular to the first straight reference line falls within a range of 5.0 mm to 10 mm.

According to an embodiment of the present invention, the light transmissive cover has an atomization structure located on a surface of the light transmissive cover or inside the light transmissive cover.

According to an embodiment of the present invention, the light source module further includes a connector. The connector includes an insulation base and two electrode poles. The insulation base is disposed on the carrier and located within the containing space. The carrier has a first end and a second end opposite to each other, and the insulation base is disposed on the first end. A part of each of the electrode poles is inserted into the insulation base, and another part of the electrode pole is extended out of the containing space. The electrode poles are electrically connected to the first line of light-emitting devices and the second line of light-emitting devices.

According to an embodiment of the present invention, the number of the light source modules are two, wherein the two first ends and the two second ends of the two light source modules are arranged on a third straight reference line, the two second ends of the two light source modules are adjacent to each other, and the two second ends of the two light source modules are located between the two first ends of the two light source modules.

According to an embodiment of the present invention, one of the two electrode poles of each connector is a positive electrode, and the other electrode pole of the connector is a negative electrode. The two positive electrodes of the two connectors are disposed on a fourth straight reference line, and the two negative electrodes of the two connectors are disposed on a fifth straight reference line, wherein the fourth straight reference line and the fifth straight reference line intersect between the two connectors.

According to an embodiment of the present invention, the insulation base has a first side surface, a second side surface, a lower surface, and two second through holes. The second side surface is opposite to the first side surface. The lower surface connects the first side surface and the second side surface. The second through holes run through the insulation base and are extended from the first side surface to the second side surface. The two electrode poles respectively run through the two second through holes. Each of the electrode poles has a first end and a second end opposite to each other, and the first end is protruded from the first side surface. The connector further includes two L-shaped electrode sheets. Each of the L-shaped electrode sheets includes a bottom portion and a connecting portion, wherein the bottom portion is disposed on the lower surface and connected to the carrier, and the connecting portion is connected to the bottom portion and disposed on the second side surface. The connecting portions of the L-shaped electrode sheets are respectively connected to the second ends of the electrode poles.

According to an embodiment of the present invention, the second ends of the electrode poles are respectively riveted with the connecting portions of the L-shaped electrode sheets. The second ends of the electrode poles respectively run through the connecting portions to be riveted with the connecting portions. The bottom portions of the L-shaped electrode sheets are welded to the carrier.

According to an embodiment of the present invention, the carrier may be a circuit board.

According to an embodiment of the present invention, each of the L-shaped electrode sheets has a pin, wherein the pin is located below the lower surface and protruded away from the lower surface, and the pin runs through the carrier.

According to an embodiment of the present invention, the first side surface has two indentations respectively communicating with the two second through holes. Each of the electrode poles has a flange located between the first end and the second end, and the flanges of the electrode poles are respectively embedded into the indentations. The internal diameter of the indentations is greater than the internal diameter of the second through holes.

According to an embodiment of the present invention, the electrode poles are substantially parallel to each other.

According to an embodiment of the present invention, the light tube further includes an insulation pad disposed at one end of the containing space. The insulation pad has a non-axial-symmetric protrusion and two third through holes. The non-axial-symmetric protrusion is protruded away from the containing space. The third through holes run through the protrusion and the insulation pad. The two electrode poles of the connector are extended out of the containing space by respectively running through the two third through holes.

According to an embodiment of the present invention, the light tube further includes a side cover which covers one end of the heat sink and one end of the light transmissive cover and has a non-axial-symmetric opening. The non-axial-symmetric protrusion is embedded into the non-axial-symmetric opening, and the two electrode poles are extended out of the containing space by running through the non-axial-symmetric opening.

According to an embodiment of the present invention, the insulation pad has a notch, the side cover has a fourth through hole, and the light tube further has a second locking element which locks the side cover to the end of the heat sink by running through the fourth through hole and the notch.

According to an embodiment of the present invention, the heat sink further has a plurality of heat dissipating fins disposed at one side of the heat sink facing away from the carrying surface.

According to an embodiment of the present invention, the heat sink has at least one rib, and an edge of the carrier is located between the rib and the carrying surface.

According to an embodiment of the present invention, the heat sink has two first locking portions respectively disposed at two opposite sides of the heat sink. The light transmissive cover has two second locking portions respectively disposed at two opposite sides of the light transmissive cover. The two second locking portions are respectively locked to the two first locking portions to fasten the light transmissive cover to the heat sink.

In the light tube according to the embodiment of the present invention, a separation space is kept between the first line of light-emitting devices and the second line of light-emitting devices so that the light source is more dispersed. Accordingly, the lights emitted by the first line of light-emitting devices and the second line of light-emitting devices are more uniform after they passes through the light transmissive cover. Thus, the light tube is suitable for illumination of general purpose. Moreover, the existence of the separation space allows the heat produced by the first line of light-emitting devices and the second line of light-emitting devices to be more dispersed, so that the heat dissipation capability of the light tube can be improved. Namely, the temperature of the first line of light-emitting devices and the second line of light-emitting devices is reduced, and accordingly the light emitting efficiency and lifespan of the first light-emitting devices and the second light-emitting devices are improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
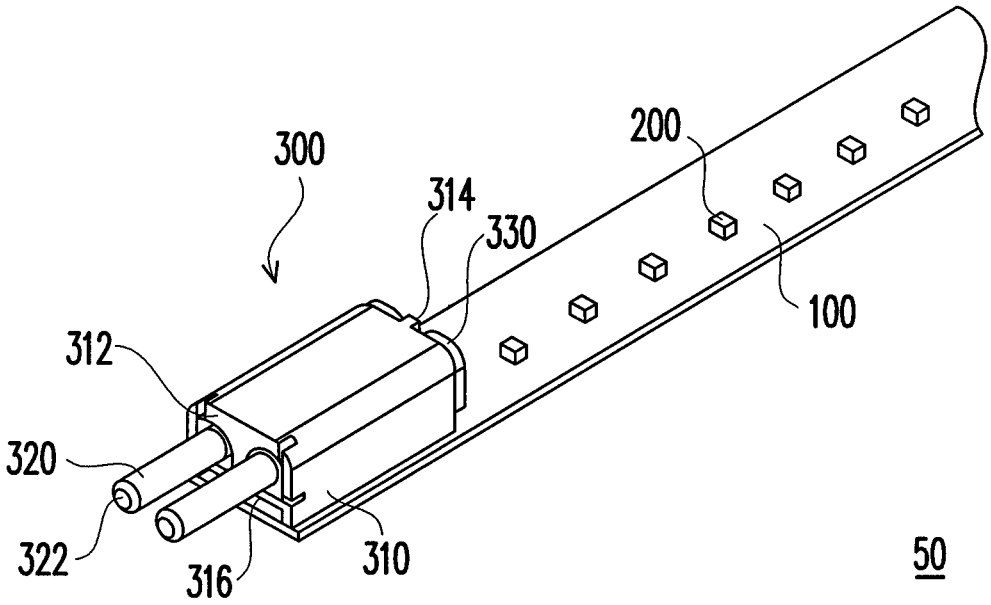
FIG. 1 is a diagram of a light source module according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
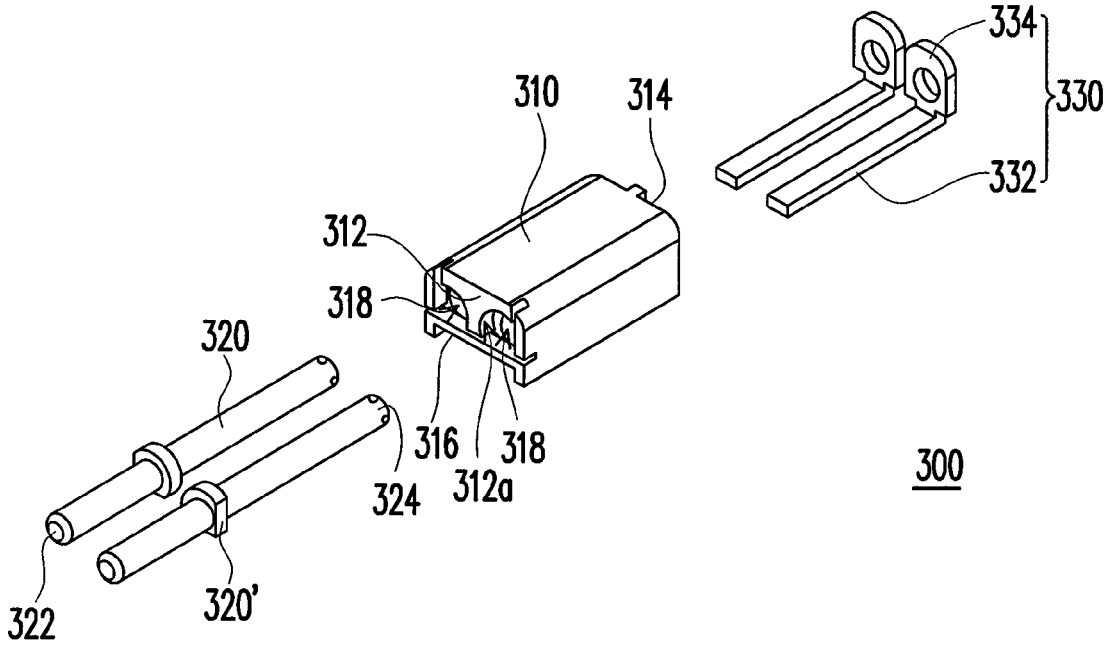
FIG. 2 is an exploded view of the connector in the light source module in FIG. 1.

FIG. 1 is a diagram of a light source module according to an embodiment of the present invention. FIG. 2 is an exploded view of a connector in the light source module in FIG. 1. Referring to FIG. 1 and FIG. 2, the light source module 50 includes a carrier 100 and a plurality of light-emitting devices 200, wherein the light-emitting devices 200 are disposed on the carrier 100. In the present embodiment, the carrier 100 may be a circuit board, and the light-emitting devices 200 may be light-emitting diodes (LEDs). In the present embodiment, the light-emitting devices 200 are arranged on the circuit board along a straight reference line. In the present embodiment, the light source module 50 further includes a connector 300 disposed on the carrier 100, and the light-emitting devices 200 are electrically connected to the connector 300. To be specific, the connector 300 is disposed on one end of the carrier 100.

In the present embodiment, the connector 300 includes an insulation base 310 and two electrode poles 320, wherein a part of each electrode pole 320 is inserted into the insulation base 310, and the electrode poles 320 are electrically connected to the light-emitting devices 200. To be specific, the insulation base 310 has a first side surface 312, a second side surface 314, a lower surface 316, and two through holes 318. The second side surface 314 is disposed opposite to the first side surface 312, and the lower surface 316 connects the first side surface 312 and the second side surface 314.

In the present embodiment, the two through holes 318 of the insulation base 310 run through the insulation base 310 and are extended from the first side surface 312 to the second side surface 314. The two electrode poles 320 respectively run through the two through holes 318, and the first ends 322 of the electrode poles 320 are protruded from the first side surface 312 to be inserted into a socket on a base (not shown), so as to be electrically connected to the base. In the present embodiment, the base conforms to the G5 specification. However, in another embodiment of the present invention, the base may also conform to other specifications. Besides, in the present embodiment, each of the electrode poles 320 presents a circular column shape. However, in another embodiment of the present invention, each of the electrode poles may also present a quadrangular column shape or other column shapes.

In the present embodiment, the connector 300 further includes two L-shaped electrode sheets 330. Each of the L-shaped electrode sheets 330 includes a bottom portion 332 and a connecting portion 334. The bottom portion 332 is disposed on the lower surface 316 of the insulation base 310 and is connected to the carrier 100, and the connecting portion 334 is connected to the bottom portion 332. In the present embodiment, the bottom portion 332 is welded to the carrier 100 to provide a reliable fastening effect to the connector 300. For example, the bottom portion 332 is welded to the carrier 100 through a surface mount technology (SMT). The connecting portions 334 are disposed on the second side surface 314 and are respectively connected to the second ends 324 of the electrode poles 320. In other words, the L-shaped electrode sheets 330 are connected between the carrier 100 and the electrode poles 320 so that the electrode poles 320 can be electrically connected to the carrier 100 through the L-shaped electrode sheets 330.

In the present embodiment, the first side surface 312 of the connector 300 has two indentations 312*a* which are respectively connected to the two through holes 318. To be specific, the internal diameter of the through holes 318 is suitable for containing the electrode poles 320, and the internal diameter of the indentations 312*a* is greater than the internal diameter of the through holes 318. In addition, each electrode pole 320 further has a flange 320' located between the first end 322 and the second end 324. At assembly time, the flanges 320' of the electrode poles 320 are respectively embedded into the indentations 312*a* to fasten the electrode poles 320 into the insulation base 310 of the connector 300.

Figure 3A:
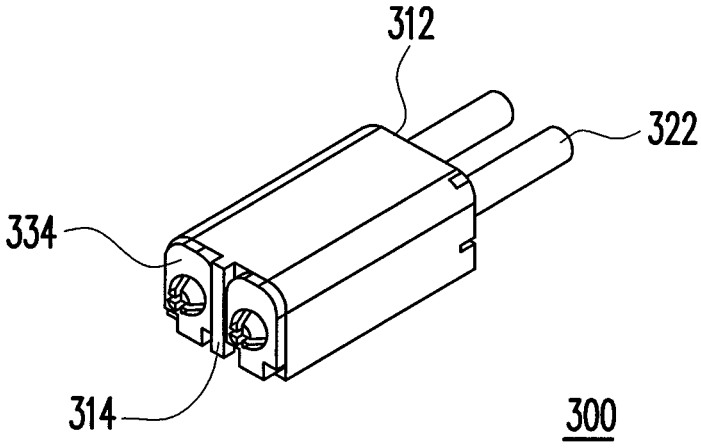
FIG. 3A is a perspective view of the connector in FIG. 1.
Figure 3B:
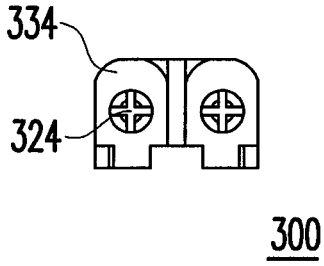
FIG. 3B is a side view of the connector in FIG. 1.

FIG. 3A is a perspective view of the connector in FIG. 1, and FIG. 3B is a side view of the connector in FIG. 1. Referring to FIG. 2, FIG. 3A, and FIG. 3B, in the present embodiment, the second ends 324 of the electrode poles 320 are riveted with the connecting portions 334 of the L-shaped electrode sheets 330. To be specific, the second ends 324 of the electrode poles 320 run through the connecting portions 334 to be riveted with the connecting portions 334.

Figure 4:
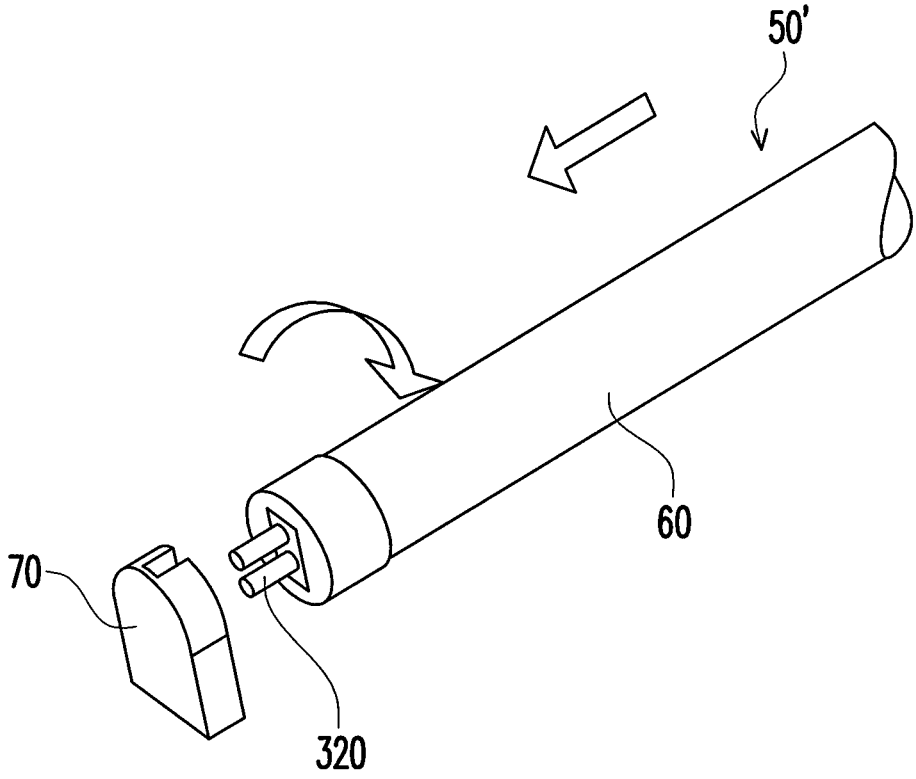
FIG. 4 is a diagram of a light tube assembled to a base according to an embodiment of the present invention.

FIG. 4 is a diagram of a light tube assembled to a base according to an embodiment of the present invention. Referring to FIG. 1, FIG. 2, and FIG. 4, in the present embodiment, the light tube 50' includes foregoing light source module 50 (as shown in FIG. 1) and a light transmissive cover 60. The light transmissive cover 60 covers the carrier 100 and the light-emitting devices 200. When the light tube 50' is assembled to a base 70, the electrode poles 320 of the connector 300 are first inserted into the base 70, and the light tube 50' is then turned for an angle to a fastened position, so as to connect the electrode poles 320 to an external power supply. In the present embodiment, the electrode poles 320 are inserted into the through holes 318 of the insulation base 310, and the bottom portions 332 of the L-shaped electrode sheets 330 have a large bonding surface with the carrier 100. Thus, when the light tube 50' is turned, the insulation base 310 can support the electrode poles 320 against the external force, and the bottom portions 332 can be firmly fastened to the carrier 100 and will thus not fall off due to the external force. Thereby, the durability of the light source module 50 and the light tube 50' is improved.

In addition, because in the present embodiment, the two electrode poles 320 of the connector 300 are inserted into the two through holes 318 of the insulation base 310, the parallelism between the electrode poles 320 can be maintained at the assembly time as long as the two through holes 318 are made parallel to each other when the insulation base 310 is fabricated. Thereby, the production yield of the connector 300 in the present embodiment is improved.

Figure 5:
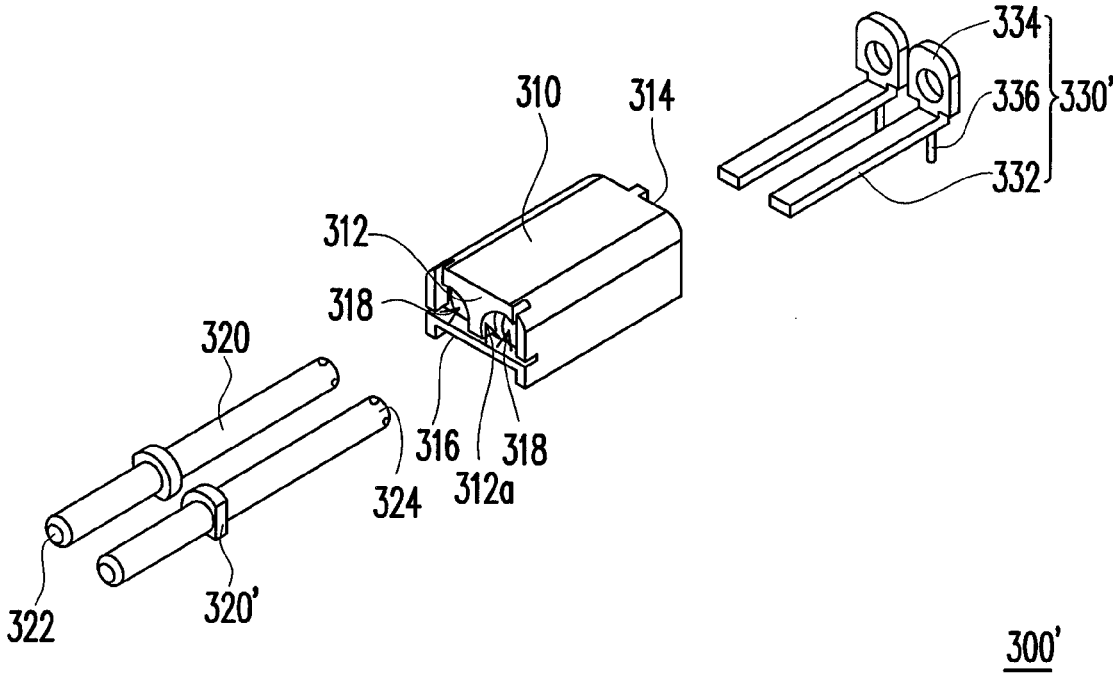
FIG. 5 is an exploded view of a connector according to another embodiment of the present invention.

FIG. 5 is an exploded view of a connector according to another embodiment of the present invention. Referring to FIG. 5, the connector 300' in the present embodiment is similar to the connector 300 as shown in FIG. 2, and the difference between the two will be described hereinafter. In the connector 300', each L-shaped electrode sheet 330' further has a pin 336 located below the lower surface 316 and protruded away from the same. The pin 336 is bonded to the carrier by running the pin 336 through a drilled hole in the carrier 100 and then welding the pin 336 and the carrier 100 together. Accordingly, the L-shaped electrode sheets 330' can be bonded with the carrier 100 firmly.

Figure 6A:
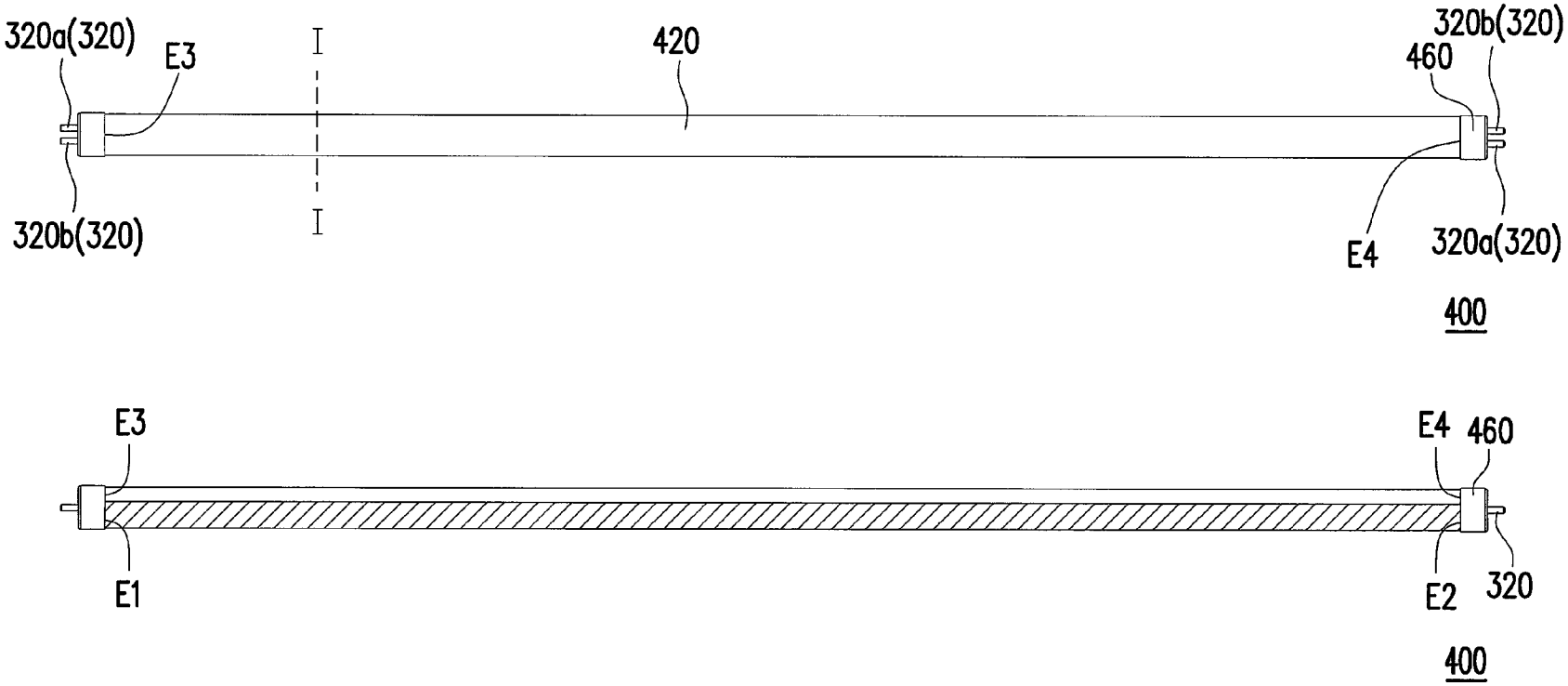
FIG. 6A is a front view and a side view of a light tube from top to bottom according to yet another embodiment of the present invention.
Figure 6B:
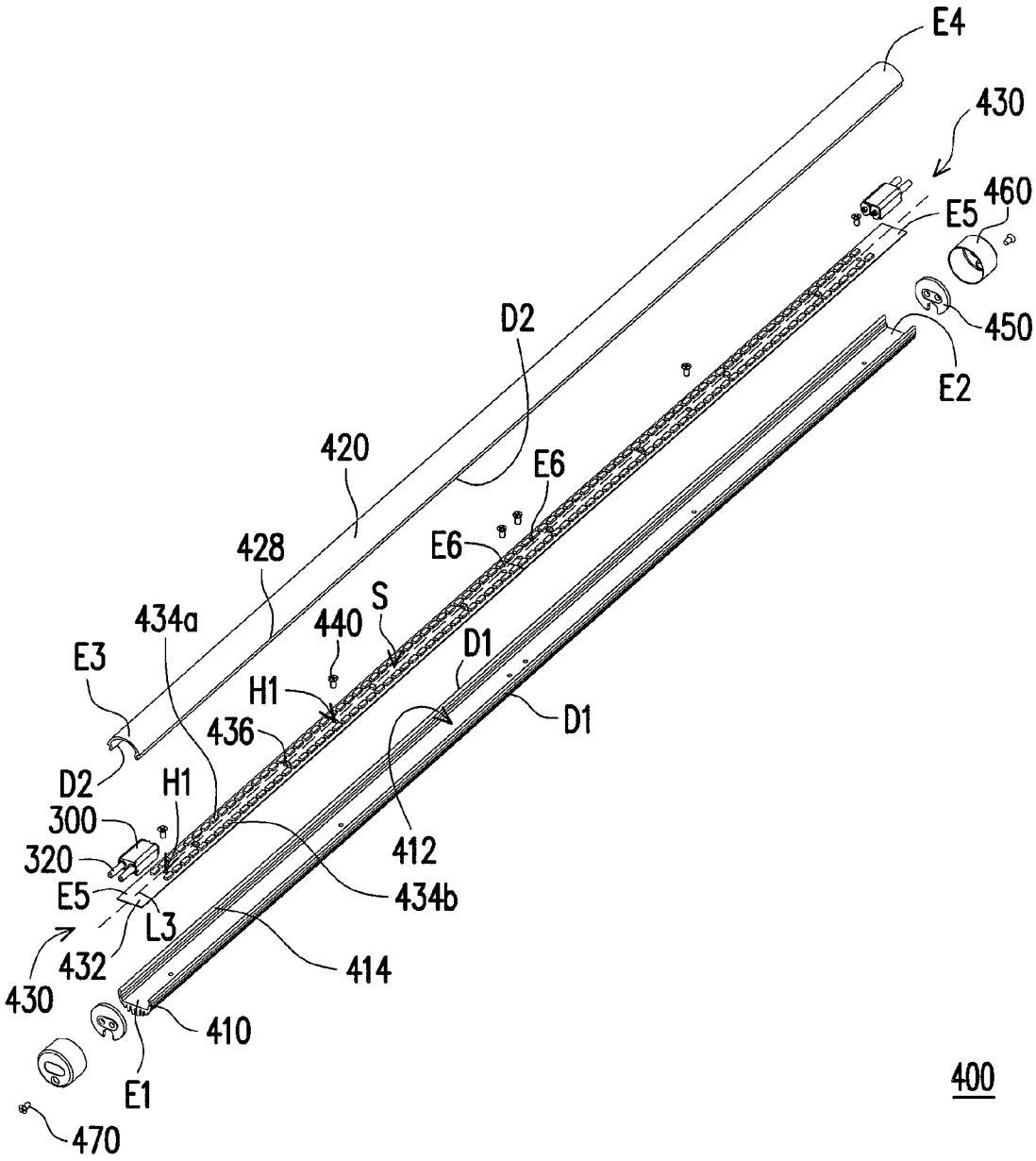
FIG. 6B is an exploded view of the light tube in FIG. 6A.
Figure 6C:
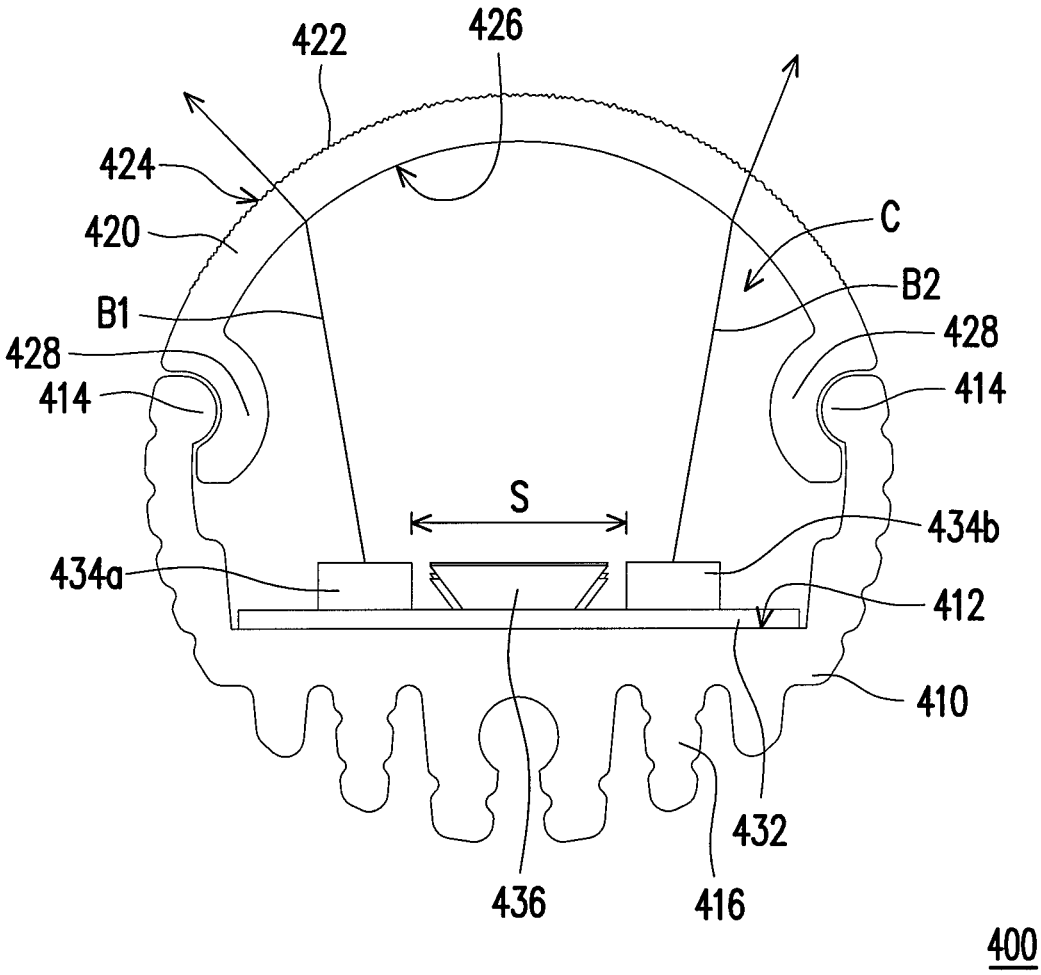
FIG. 6C is a cross-sectional view of the light tube in FIG. 6A along line I-I.

FIG. 6A is a front view and a side view of a light tube from top to bottom according to yet another embodiment of the present invention, FIG. 6B is an exploded view of the light tube in FIG. 6A, and FIG. 6C is a cross-sectional view of the light tube in FIG. 6A along line I-I. Referring to FIGS. 6A~6C, in the present embodiment, the light tube 400 includes a heat sink 410, a light transmissive cover 420, and two light source modules 430. The heat sink 410 has a carrying surface 412. The light transmissive cover 420 is disposed on the heat sink 410, wherein a containing space C (as shown in FIG. 6C) is formed between the heat sink 410 and the light transmissive cover 420, and the carrying surface 412 faces the containing space C.

Figure 7:
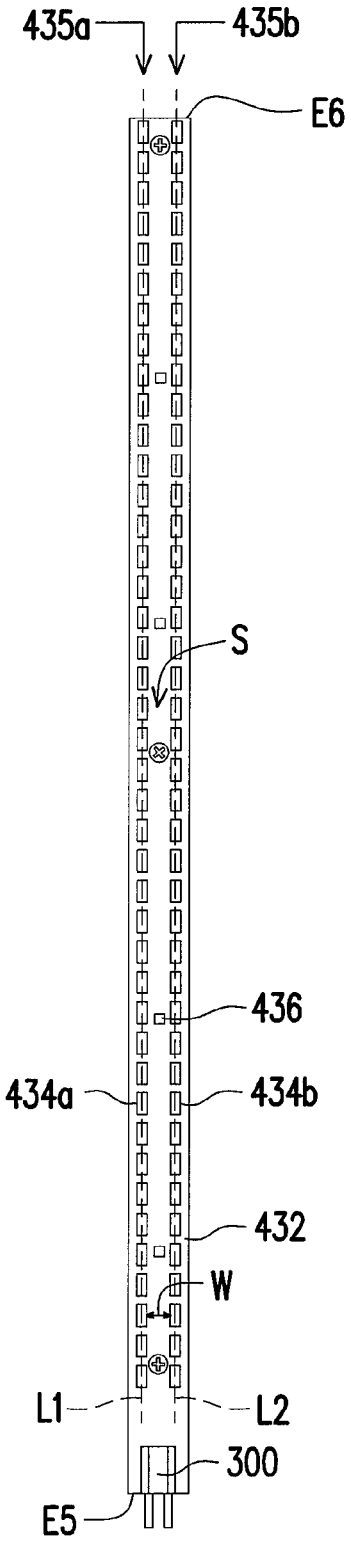
FIG. 7 is a front view of a light source module in FIG. 6B.

FIG. 7 is a front view of a light source module in FIG. 6B. Referring to FIG. 6B, FIG. 6C, and FIG. 7, the light source modules 430 includes a carrier 432, a plurality of first light-emitting devices 434*a*, a plurality of second light-emitting devices 434*b*, and a plurality of non-light-emitting passive devices 436. The carrier 432 is disposed on the carrying surface 412 and located within the containing space C. In the present embodiment, the carrier 432 may be a circuit board. Besides, in the present embodiment, the carrier 432 is adhered to the carrying surface 412 through a thermal grease, a heat sink tape, or other heat-conductive but non-electricity-conductive materials.

The first light-emitting devices 434*a* are arranged on the carrier 432 along a first straight reference line L1, so as to form a first line of light-emitting devices 435*a* (as shown in FIG. 7). The second light-emitting devices 434*b* are arranged on the carrier 432 along a second straight reference line L2, so as to form a second line of light-emitting devices 435*b*. In the present embodiment, the first straight reference line L1 is substantially parallel to the second straight reference line L2. Besides, in the present embodiment, the first light-emitting devices 434*a* and the second light-emitting devices 434*b* are all LEDs. A separation space S is kept between the first line of light-emitting devices 435*a* and the second line of light-emitting devices 435*b*. The non-light-emitting passive devices 436 are disposed on the carrier 432 and located within the separation space S, wherein the non-light-emitting passive devices 436 are electrically connected to the first light-emitting devices 434*a* and the second light-emitting devices 434*b*. In the present embodiment, the non-light-emitting passive devices 436 may be resistors, fuses, Schottky diodes, or any combination of the foregoing elements. To be specific, the first light-emitting devices 434*a* and the second light-emitting devices 434*b* may all be surface mount device (SMD) LEDs, and the fuses may be SMD type fuses.

In the present embodiment, the carrier 432 has a plurality of through holes H1 (as shown in FIG. 6B), and these through holes H1 are extended from the separation space S toward the carrying surface 412 and run through the carrier 432. The light tube 400 further includes a plurality of first locking elements 440 which lock the carrier 432 to the heat sink 410 by respectively running through the through holes H1. In the present embodiment, the light transmissive cover 420 has an atomization structure 422 (as shown in FIG. 6C) located on the surface of the light transmissive cover 420. In FIG. 6C, the atomization structure 422 is located on an external surface 424 of the light transmissive cover 420 which is facing away from the containing space C, and the atomization structure 422 is a rough microstructure. However, in another embodiment of the present invention, the atomization structure 422 may also be located on an internal surface 426 of the light transmissive cover 420 which faces the containing space C. Alternatively, in yet another embodiment of the present invention, the atomization structure 422 may also be located inside the light transmissive cover 420. For example, the atomization structure 422 may be a light-scattering microstructure or light-scattering particles in the light transmissive cover 420. The first light-emitting devices 434*a* and the second light-emitting devices 434*b* are suitable for respectively emitting a light beam B1 and a light beam B2, and the atomization structure 422 is suitable for scattering the light beams B1 and B2 to allow the light tube 400 to provide a uniform illumination.

In the present embodiment, the heat sink 410 has two first locking portions 414 respectively disposed at two opposite sides D1 of the heat sink 410, wherein the two opposite sides D1 are extended from a first end E1 of the heat sink 410 to a second end E2 of the heat sink 410. Besides, in the present embodiment, the light transmissive cover 420 has two second locking portions 428 respectively disposed at two opposite sides D2 of the light transmissive cover 420, wherein the two opposite sides D2 are extended from a first end E3 of the light transmissive cover 420 to a second end E4 of the light transmissive cover 420. The two second locking portions 428 are respectively locked to the two first locking portions 414 to fasten the light transmissive cover 420 to the heat sink 410. In the present embodiment, the first locking portions 414 may be strip-shaped protrusions, and the second locking portions 428 may be strip-shaped lock clasps. However, in another embodiment of the present invention, the first locking portions 414 and the second locking portions 428 may also be respectively strip-shaped lock clasps and strip-shaped protrusions. Alternatively, one of the first locking portion 414 and the second locking portion 428 may also be a strip-shaped groove, and the other one of the first locking portion 414 and the second locking portion 428 may also be a strip-shaped protrusion. The light transmissive cover 420 may be pushed downwards or slid onto the heat sink 410. The light transmissive cover 420 and the heat sink 410 present a tube shape after they are assembled and therefore can be used for replacing the conventional fluorescent light tube.

Moreover, in the present embodiment, the heat sink 410 further has a plurality of heat dissipating fins 416 disposed at one side of the heat sink 410 facing away from the carrying surface 412, so as to increase the heat dissipating surface. Accordingly, the heat dissipation efficiency of the light tube 400 is improved.

In the present embodiment, the light source module 430 further includes a connector 300, wherein the connector 300 is the same as the connector 300 illustrated in FIG. 1. The carrier 432 has a first end E5 and a second end E6 opposite to each other, and the insulation base 310 of the connector 300 is disposed on the first end E5. In addition, the electrode poles 320 of the connector 300 are electrically connected to the first line of light-emitting devices 435*a* and the second line of light-emitting devices 435*b*. Moreover, the bottom portions 332 of the L-shaped electrode sheets 330 of the connector 300 are connected to the carrier 432. In the present embodiment, the bottom portions 332 of the L-shaped electrode sheets 330 are welded onto the carrier 432. However, in another embodiment of the present invention, the connector 300' illustrated in FIG. 5 may also be used for replacing the connector 300 in FIG. 6B, and the pin 336 of each L-shaped electrode sheet 330' in the connector 300' runs through the carrier 432.

In the present embodiment, the two first ends E5 and the two second ends E6 of the two light source modules 430 in the light tube 400 are arranged on a third straight reference line L3 (as shown in FIG. 6B), wherein the two second ends E6 of the two light source modules 430 are adjacent to each other, and the two second ends E6 of the two light source modules 430 are located between the two first ends E5 of the light source modules 430.

Figure 8A:
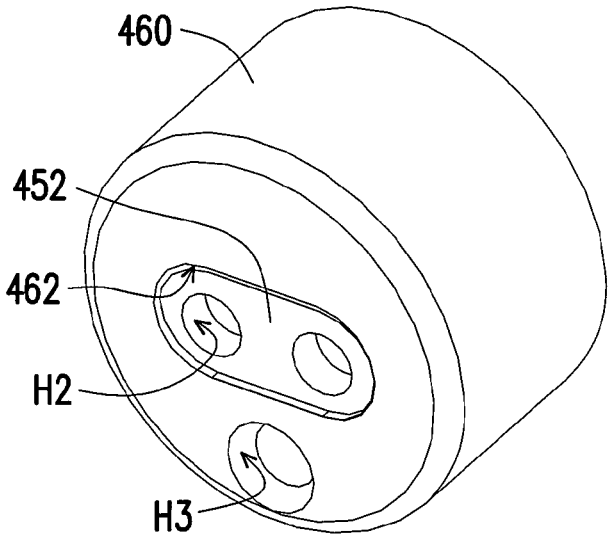
FIG. 8A is a perspective view of an insulation pad and a side cover in FIG. 6B when the two are assembled.
Figure 8B:
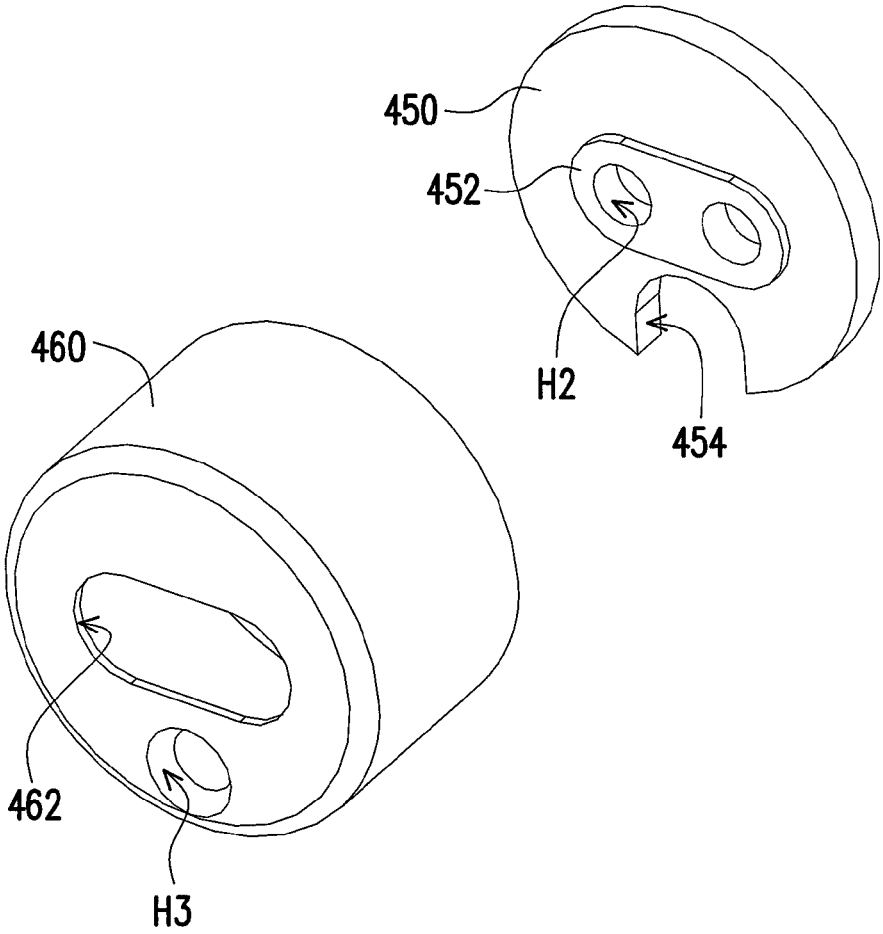
FIG. 8B and FIG. 8C are perspective views from different angles of the insulation pad and the side cover in FIG. 8A when the two are disassembled.
Figure 8C:
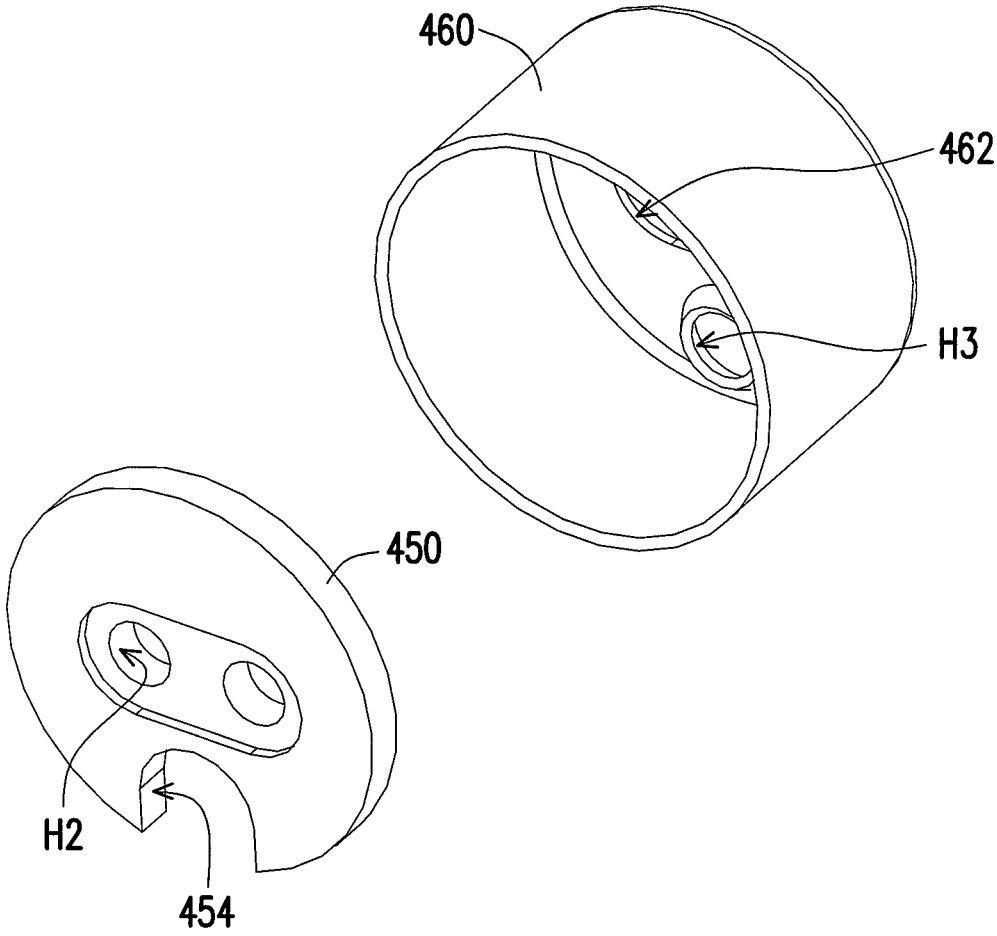
Figure 9:
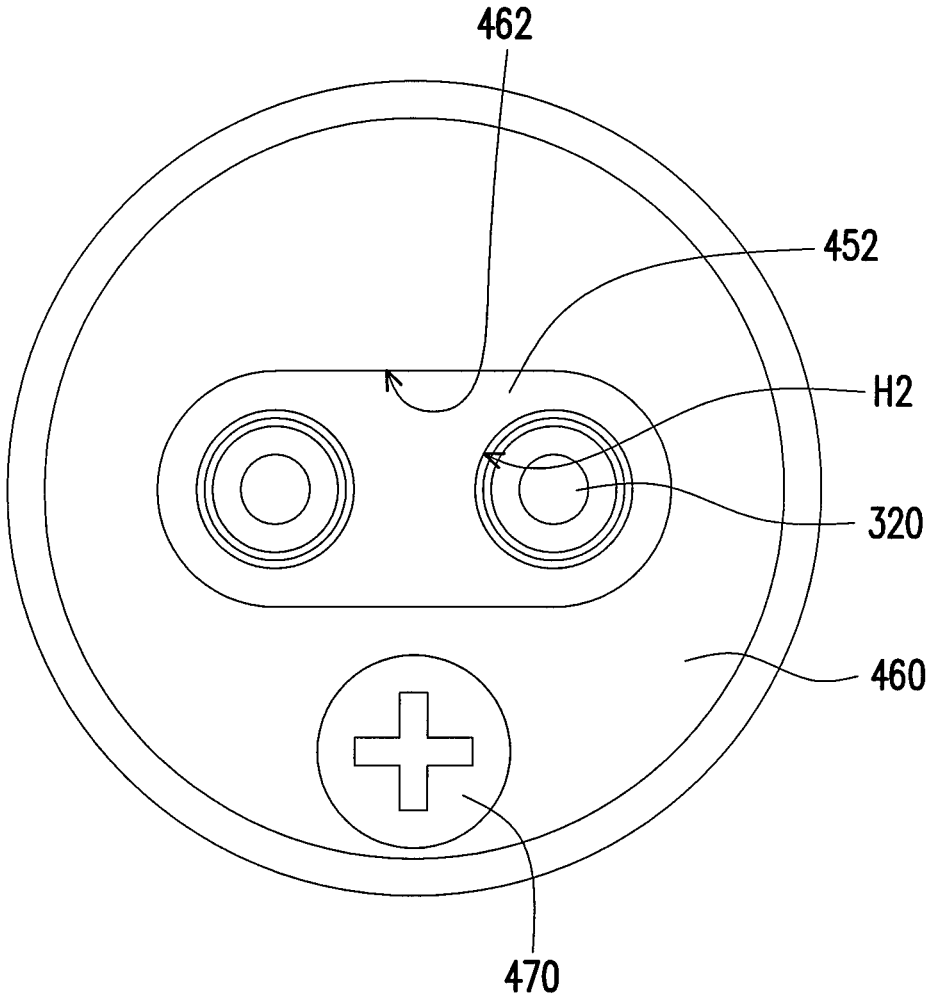
FIG. 9 is a front view of one end of the light tube in FIG. 6A.

FIG. 8A is a perspective view of the insulation pad and the side cover in FIG. 6B when the two are assembled, FIG. 8B and FIG. 8C are perspective views from different angles of the insulation pad and the side cover in FIG. 8A when the two are disassembled, and FIG. 9 is a front view of one end of the light tube in FIG. 6A. Referring to FIG. 6B, FIGS. 8A~8C, and FIG. 9, in the present embodiment, the light tube 400 further includes two insulation pads 450 respectively disposed at two opposite ends of the containing space C (as shown in FIG. 6C). Each of the insulation pads 450 has a non-axial-symmetric protrusion 452 and two through holes H2. The non-axial-symmetric protrusion 452 is protruded away from the containing space C (as shown in FIG. 6C). The through holes H2 run through the non-axial-symmetric protrusion 452 and the insulation pad 450, wherein the two electrode poles 320 of the connector 300 are respectively extended out of the containing space C by running through the two through holes H2 (as shown in FIG. 6C). In the present embodiment, the material of the insulation pad 450 may be bakelite.

In the present embodiment, the light tube further includes two side covers 460 respectively covering the first end E1 and the second end E2 of the heat sink 410 and respectively covering the first end E3 and the second end E4 of the light transmissive cover 420. Each side cover 460 has a non-axial-symmetric opening 462. The non-axial-symmetric protrusion 452 is embedded into the non-axial-symmetric opening 462, and the two electrode poles 320 are extended out of the containing space C by running through the non-axial-symmetric opening 462 (as shown in FIG. 6C). In the present embodiment, the non-axial-symmetric protrusion 452 presents a short strip shape with two arc ends, and the non-axial-symmetric opening 462 presents the same shape. Such a design prevents the non-axial-symmetric protrusion 452 from rotating relative to the non-axial-symmetric opening 462 after the non-axial-symmetric protrusion 452 is embedded into the non-axial-symmetric opening 462. Accordingly, the fixity of the side covers 460 is increased. In the present embodiment, the material of the side covers 460 is a metal, such as steel.

In the present embodiment, each of the insulation pads 450 has a notch 454, each of the side covers 460 has a through hole H3, and the light tube 400 has two second locking elements 470 (as shown in FIG. 6B). The second locking elements 470 lock the side covers 460 to one end of the heat sink 410 by running through the through hole H3 and the notch 454. To be specific, the two second locking elements 470 respectively lock the two side covers 460 to the first end E1 and the second end E2 of the heat sink 410.

In the light tube 400 of the present embodiment, the light source is dispersed because a separation space S is kept between the first line of light-emitting devices 435*a* and the second line of light-emitting devices 435*b*. Accordingly, the light emitted by the first line of light-emitting devices 435*a* and the second line of light-emitting devices 435*b* is more uniform after it is scattered by the light transmissive cover and therefore can be used for illumination of general purpose. Besides, the separation space S also allows the heat produced by the first line of light-emitting devices 435*a* and the second line of light-emitting devices 435*b* to be more dispersed. Accordingly, the heat dissipation capability of the light tube 400 is improved. Namely, the temperature of the first line of light-emitting devices 435*a* and the second line of light-emitting devices 435*b* when working is reduced and accordingly the light emitting efficiency and lifespan of the first light-emitting devices 434*a* and the second light-emitting devices 434*b* are improved. In order to allow the light tube 400 to provide more uniform illumination and higher heat dissipation efficiency, in the present embodiment, the width W (as shown in FIG. 7) of the separation space S in the direction perpendicular to the first straight reference line L1 is designed to fall within a range of 5.0 mm to 10 mm.

In addition, the light tube 400 in the present embodiment has the same connector 300 as the light source module 50 (as shown in FIG. 1), such that the light tube 400 has the same functionality and advantages as those of the above light source module 50, the details of which are omitted herein.

Figure 10:
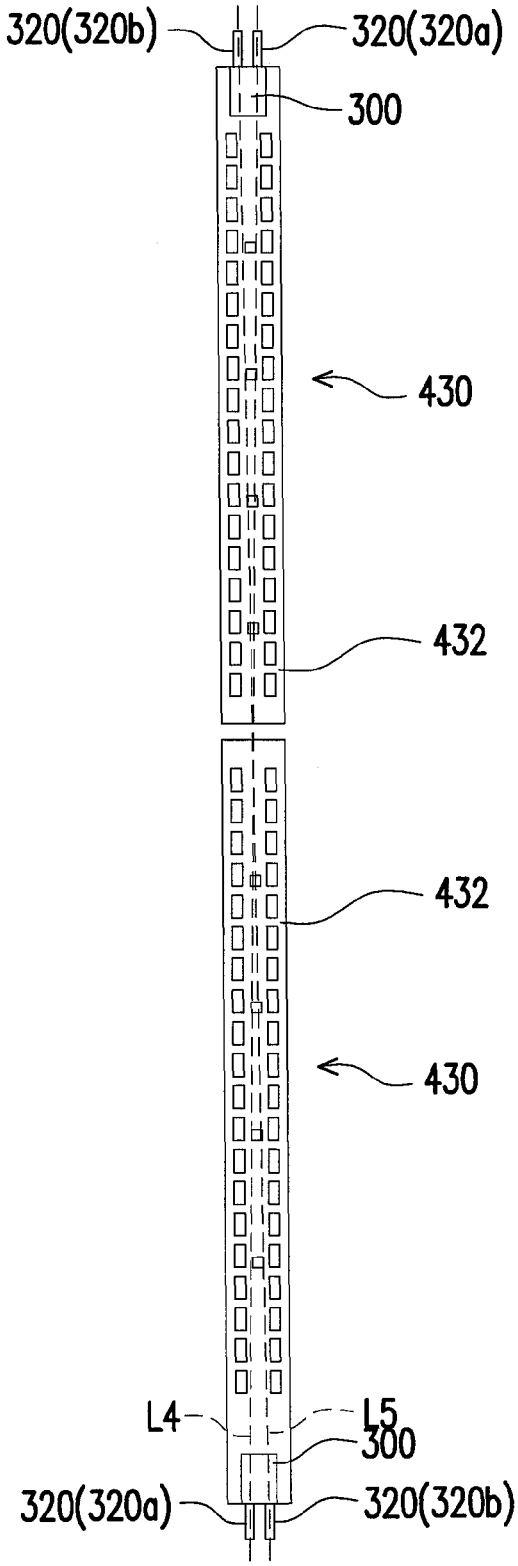
FIG. 10 is a front view of the two light source modules in FIG. 6B.

FIG. 10 is a front view of the two light source modules in FIG. 6B. Referring to FIG. 6B and FIG. 10, in the present embodiment, one of the two electrode poles 320 of each connector 300 is a positive electrode 320*a* electrically connected to the anodes of the first light-emitting devices 434*a* and the second light-emitting devices 434*b*, and the other one of the two electrode poles 320 of the connector 300 is a negative electrode 320*b* electrically connected to the cathodes of the first light-emitting devices 434*a* and the second light-emitting devices 434*b*. The two positive electrodes 320*a* of the two connectors 300 are disposed on a fourth straight reference line L4, and the two negative electrodes 320*b* of the two connectors 300 are disposed on a fifth straight reference line L5, wherein the fourth straight reference line L4 and the fifth straight reference line L5 intersect between the two connectors 300. In other words, the two positive electrodes 320*a* and the two negative electrodes 320*b* of the two connectors 300 are disposed alternately, and such a fool proof design can prevent the user from inserting the positive electrode 320*a* into the negative hole of the socket on the base or inserting the negative electrode 320*b* into the positive hole of the socket on the base. To be specific, when the disposition of the light tube 400 allows the two light source modules 430 to be disposed as shown in FIG. 10, the positive electrode 320*a* of the two light source modules 430 at the upper portion of FIG. 10 is located at the right side of the negative electrode 320*b*, and the positive electrode 320*a* at the lower portion of FIG. 10 is located at the left side of the negative electrode 320*b*. When the user turns the light tube 400 for 180°, the upper positive electrode 320*a* is still located at the right side of the negative electrode 320*b*, and the lower positive electrode 320*a* is still located at the left side of the negative electrode 320*b*. Herein, as long as the upper socket is designed to have the positive hole at right and the negative hole at left and the lower socket to have the positive hole at left and the negative hole at right, the positive electrode 320*a* and the negative electrode 320*b* can be respectively inserted into the positive hole and the negative hole of the socket correctly regardless of in which direction the light tube 400 is assembled to the base.

Figure 11A:
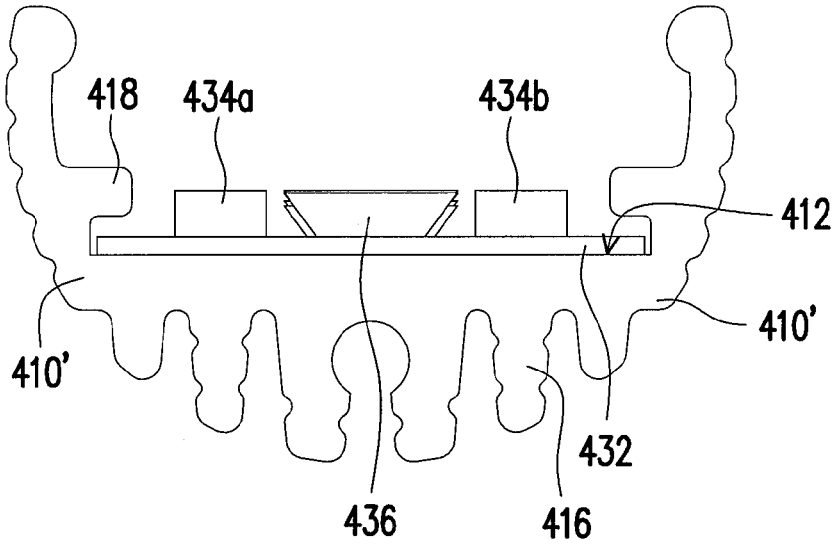
FIG. 11A is a cross-sectional view of first light-emitting devices, second light-emitting devices, a carrier, and a heat sink of a light tube according to still another embodiment of the present invention.
Figure 11B:
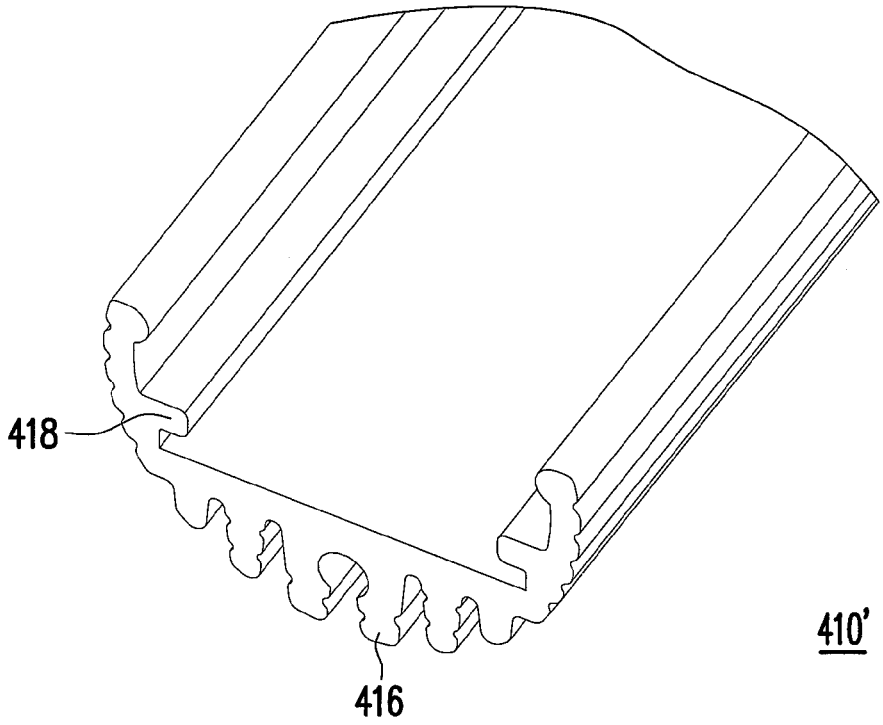
FIG. 11B is a partial perspective view of the heat sink in FIG. 11A.

FIG. 11A is a cross-sectional view of first light-emitting devices, second light-emitting devices, a carrier, and a heat sink of a light tube according to still another embodiment of the present invention, and FIG. 11B is a partial perspective view of the heat sink in FIG. 11A. Referring to FIG. 11A and FIG. 11B, the light tube in the present embodiment is similar to the light tube as shown in FIG. 6C, and the difference between the two is that in the present embodiment, the heat sink 410' further has two ribs 418. An edge of the carrier 432 is located between one of the ribs 418 and the carrying surface 412, and another edge of the carrier 432 is located between the other rib 418 and the carrying surface 412. The ribs 418 prevent the carrier 432 from warping too much under a thermal stress so that the carrier 432 can be attached as closely as possible onto the carrying surface 412. Accordingly, it is ensured that the heat produced by the carrier 432 can be conducted to the heat sink 410', and the heat dissipating efficiency of the light tube can be improved.

As described above, in the light tube according to the embodiment of the present invention, a separation space is kept between the first line of light-emitting devices and the second line of light-emitting devices such that the light source can be more dispersed. Accordingly, the light emitted by the first line of light-emitting devices and the second line of light-emitting devices becomes more uniform after it passes through the light transmissive cover and therefore can be used for illumination of general purpose. Besides, the separation space also allows the heat produced by the first line of light-emitting devices and the second line of light-emitting devices to be more dispersed so that the heat dissipation efficiency of the light tube can be improved. Namely, the temperature of the first line of light-emitting devices and the second line of light-emitting devices is reduced, and accordingly the light emitting efficiency and lifespan of the first light-emitting devices and the second light-emitting devices are improved.

Moreover, because the electrode poles are inserted into the through holes of the insulation base and the bottom portions of the L-shaped electrode sheets have a large bonding surface with the carrier, the insulation base can support the electrode poles against the external force, and the bottom portions of the L-shaped electrode sheets can be firmly fastened to the carrier and not fall off. Thus, the durability of the light tube in the present invention is improved. Furthermore, because the two electrode poles of the connector are inserted into the two through holes of the insulation base, the parallelism of the electrode poles may be maintained at assembly time as long as the two through holes are made parallel to each other when the insulation base is fabricated. Thus, the production yield of the connector is improved, and accordingly the production yield and the quality of the light tube are also improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light tube, comprising:

a heat sink, having a carrying surface;

a light transmissive cover, disposed on the heat sink, wherein a containing space is formed between the heat sink and the light transmissive cover, and the carrying surface faces the containing space;

at least one light source module, comprising:

a carrier, disposed on the carrying surface and located within the containing space;

a plurality of first light-emitting devices, arranged on the carrier along a first straight reference line, so as to form a first line of light-emitting devices;

a plurality of second light-emitting devices, arranged on the carrier along a second straight reference line, so as to form a second line of light-emitting devices, wherein a separation space is kept between the first line of light-emitting devices and the second line of light-emitting devices;

a plurality of non-light-emitting passive devices, disposed on the carrier and located within the separation space, wherein the non-light-emitting passive devices are electrically connected to the first light-emitting devices and the second light-emitting devices; and a connector, and the connector comprises:

an insulation base, disposed on the carrier and located within the containing space, wherein the carrier has a first end and a second end opposite to each other, and the insulation base is disposed on the first end; and two electrode poles, wherein a part of each of the electrode poles is inserted into the insulation base, and another part of the electrode pole is extended out of the containing space, and the electrode poles are electrically connected to the first line of light-emitting devices and the second line of light-emitting devices; and an insulation pad disposed at one end of the containing space, wherein the insulation pad comprises:

a non-axial-symmetric protrusion, protruded away from the containing space; and two third through holes, running through the protrusion and the insulation pad, wherein the two electrode poles of the connector are extended out of the containing space respectively through the two third through holes.

2. The light tube according to claim 1, wherein the first light-emitting devices and the second light-emitting devices are all light-emitting diodes (LEDs).

3. The light tube according to claim 1, wherein the non-light-emitting passive devices comprise at least one of resistors, fuses, and Schottky diodes.

4. The light tube according to claim 1, wherein the carrier has a plurality of first through holes which are extended from the separation space toward the carrying surface and run through the carrier, and the light tube further comprises a plurality of first locking elements which respectively run through the first through holes to lock the carrier to the heat sink.

5. The light tube according to claim 1, wherein a width of the separation space in a direction perpendicular to the first straight reference line is between 5.0 mm and 10 mm.

6. The light tube according to claim 1, wherein the light transmissive cover has an atomization structure located on a surface of the light transmissive cover or inside the light transmissive cover.

7. The light tube according to claim 1, wherein the at least one of the light source module is two light source modules, the two first ends and the two second ends of the two light source modules are arranged on a third straight reference line, the two second ends of the two light source modules are adjacent to each other, and the two second ends of the two light source modules are located between the two first ends of the two light source modules.

8. The light tube according to claim 7, wherein one of the two electrode poles of each of the connectors is a positive electrode, and the other electrode pole of the connector is a negative electrode, the two positive electrodes of the two connectors are disposed on a fourth straight reference line, the two negative electrodes of the two connectors are disposed on a fifth straight reference line, and the fourth straight reference line and the fifth straight reference line intersect each other between the two connectors.

9. The light tube according to claim 1, wherein the insulation base comprises:

a first side surface;

a second side surface, opposite to the first side surface;

a lower surface, connecting the first side surface and the second side surface; and two second through holes, running through the insulation base and extended from the first side surface to the second side surface, and the two electrode poles respectively running through the two second through holes, wherein each of the electrode poles has a first end and a second end opposite to each other, and the first end is protruded from the first side surface, the connector further comprises two L-shaped electrode sheets, and each of the L-shaped electrode sheets comprises:

a bottom portion, disposed on the lower surface and connected to the carrier; and a connecting portion, connected to the bottom portion and disposed on the second side surface, wherein the connecting portions of the L-shaped electrode sheets are respectively connected to the second ends of the electrode poles.

10. The light tube according to claim 9, wherein the second ends of the electrode poles are respectively riveted with the connecting portions of the L-shaped electrode sheets.

11. The light tube according to claim 10, wherein the second ends of the electrode poles respectively run through the connecting portions to be riveted with the connecting portions.

12. The light tube according to claim 9, wherein the bottom portions of the L-shaped electrode sheets are welded to the carrier.

13. The light tube according to claim 9, wherein the carrier is a circuit board.

14. The light tube according to claim 9, wherein each of the L-shaped electrode sheets has a pin located below the lower surface and protruded away from the lower surface, and the pin runs through the carrier.

15. The light tube according to claim 9, wherein the first side surface has two indentations respectively communicating with the two second through holes, each of the electrode poles has a flange located between the first end and the second end, and the flanges of the electrode poles are respectively embedded into the indentations.

16. The light tube according to claim 15, wherein an internal diameter of the indentations is greater than an internal diameter of the second through holes.

17. The light tube according to claim 9, wherein the electrode poles are substantially parallel to each other.

18. The light tube according to claim 1 further comprising a side cover, wherein the side cover covers one end of the heat sink and one end of the light transmissive cover and has a non-axial-symmetric opening, the non-axial-symmetric protrusion is embedded into the non-axial-symmetric opening, and the two electrode poles are extended out of the containing space by running through the non-axial-symmetric opening.

19. The light tube according to claim 18, wherein the insulation pad has a notch, the side cover has a fourth through hole, and the light tube further comprises a second locking element which locks the side cover to the end of the heat sink by running through the fourth through hole and the notch.

20. The light tube according to claim 1, wherein the heat sink further has a plurality of heat dissipating fins disposed at one side of the heat sink facing away from the carrying surface.

21. The light tube according to claim 20, wherein the heat sink has at least one rib, and an edge of the carrier is located between the rib and the carrying surface.

22. The light tube according to claim 1, wherein the heat sink has two first locking portions respectively disposed at two opposite sides of the heat sink, the light transmissive cover has two second locking portions respectively disposed at two opposite sides of the light transmissive cover, and the two second locking portions are respectively locked to the two first locking portions to fasten the light transmissive cover to the heat sink.

* * * * *